US006146342A

United States Patent [19]

Glen

[11] Patent Number: 6,146,342

[45] Date of Patent: Nov. 14, 2000

[54] MASSAGE PAD WITH A PLURALITY OF RANDOMLY ACTUATED PRESSURE INDUCING ELEMENTS

[76] Inventor: Harry Glen, 2200 SE. Ranch Rd., Jupiter, Fla. 33478

[21] Appl. No.: 09/054,387

[22] Filed: Apr. 3, 1998

Related U.S. Application Data

[63] Continuation-in-part of application No. 08/700,344, Sep. 23, 1996, abandoned.

[51] Int. Cl.[7] ..... A61H 23/02

[52] U.S. Cl. ..... 601/61; 601/78; 601/111

[58] Field of Search ..... 601/78, 107, 108, 601/111, 15, 18, 19, 61, 22, 79–81, 46

[56] References Cited

U.S. PATENT DOCUMENTS 4,779,615 10/1988 Frazier .
4,788,968 12/1988 Rudashevsky et al. .
5,020,517 6/1991 Foster, Jr. et al. ..... 128/33
5,245,989 9/1993 Simon .
5,279,284 1/1994 Fenn .

*Primary Examiner*—Danton D. DeMille
*Attorney, Agent, or Firm*—Terrance L. Siemens

[57] ABSTRACT

Apparatus for massaging the body by subjecting the body to impacts from reciprocating plungers. The plungers are secured in a flat array within a flexible pad. Each plunger has an associated solenoid device which alternately causes the plunger to project from the pad and to retract within the pad. An electrical circuit includes a power cord and plug assembly, manual controls disposed serially on the cord and plug assembly, and a controller generating operating signals randomly to the solenoids. A heating element is optionally included in the flexible pad, with a suitable controller provided among the controls.

5 Claims, 4 Drawing Sheets

MASSAGE PAD WITH A PLURALITY OF RANDOMLY ACTUATED PRESSURE INDUCING ELEMENTS

REFERENCE TO RELATED APPLICATION

This is a continuing-in-part application of Ser. No. 08/700,344, filed Sep. 23, 1996 now abandoned.

BACKGROUND OF THE INVENTION

1. Field of the Invention

The present invention relates to massaging devices, and more particularly relates to massaging devices for applying pressure pulses to muscles and a related method.

2. Description of the Prior Art

Massage devices for muscle massage and muscle relaxation are known. Such devices may employ arrays of powered plungers arranged to strike the skin of a person being massaged such that impacts of the plungers collectively provide a beneficial effect which alleviates pain or provides other therapeutic results.

U.S. Pat. No. 4,779,615, issued to Richard K. Frazier on Oct. 25, 1988, U.S. Pat. No. 4,788,968, issued to German E. Rudashevsky et al. on Dec. 6, 1988, U.S. Pat. No. 5,245,989, issued to Rosalie Simon on Sep. 21, 1993, are illustrative. In each case of the prior art cited above, reciprocating plungers are controlled according to a scheme which affects one or more characteristics of plunger action. For example, Rudashevsky et al. controls frequency of plunger operation within a range of 0 to 250 Hz by connection to an AC electrical circuit. Rudashevsky et al. is concerned with design of individual plunger actuators, and is silent regarding an overall pattern of plunger action. By contrast, the present invention produces random actuation in an array or plurality of plungers.

Frazier controls a plurality of plungers in a pattern which correlates to musical characteristics, these characteristics being analyzed by a microprocessor which then issues control signals actuating individual plungers accordingly to influence frequency, amplitude, and beat. This is different from actuating individual plungers randomly, as practiced in the present invention. In fact, predictable nature of musical cadences may act to defeat randomness in that the body may come to anticipate plunger action to a degree.

Simon individually controls plungers for time duration, frequency, and pressure. Unlike the present invention, there is no provision for random actuation of plungers.

In U.S. Pat. No. 5,279,284, issued to Gordon W. Fenn on Jan. 18, 1994, plungers are activated according to specific patterns, such as progressive actuation of adjacent rows, although adjacent plungers may be asynchronous due to variable tolerances of timing components. However, the device of Fenn is a rigid, hand held device, rather than the flexible, broad pad of the present invention. Also, plungers are exposed in Fenn, whereas they are covered in the present invention.

None of the above inventions and patents, taken either singly or in combination, is seen to describe the instant invention as claimed.

SUMMARY OF THE INVENTION

The present inventor has discovered that a muscle will tense in anticipation of a stimulus, such as that produced by impact of a plunger against the skin. If, however, location and timing of impact of specific plungers cannot be predetermined with regularity, then collective impacts of many plungers will act to relax a muscle rather than to cause contraction of that muscle. The Golgi tendon organ is known for its ability to detect tension applied to the tendon by muscle contraction. When tension on the muscle and tendon becomes extreme, inhibitory effect from the tendon organ can result in sudden relaxation of the entire muscle. This effect is referred to within the discipline of reflexology as the lengthening reaction. Stated another way, the present applicant believes that the Golgi tendon organ is acted on by the present invention in a manner causing sudden relaxation of the entire muscle.

To achieve this effect, the novel massaging device adds elements assuring random actuation of individual plungers to the driving circuit of the device. The apparatus of the invention includes a pad bearing a plurality or array of individual pressure inducing elements which can act individually against the body of a user. The pad is quite broad relative to its thickness, and flexible. These characteristics assure that it can be laid against the skin over a muscle, such as on the back, and conform to body contours while remaining in substantial contact with the skin.

The pressure inducing elements, which may illustratively be solenoid operated plungers, move in reciprocating fashion to an extended position making contact with the body and to a retracted position withdrawing the plunger from contact. Individual pressure inducing elements are preferably about one quarter inch in diameter, and blunt. Spacing of individual elements in the array is on the order of an inch to two inches apart to provide density assuring effective massage.

Random operation may be provided in several ways. If pressure inducing elements are solenoid operated plungers, then electrical power inputs energizing each solenoid can be generated in random patterns. Alternatively, a microprocessor, if provided, can be programmed to issue random command signals. Regardless of the nature of the actuating apparatus, individual pressure inducing elements operate randomly.

The pressure inducing elements are contained within an envelope or pad which is generally flat, planar, and sufficiently flexible to enable it to conform to body contours. The envelope excludes dirt and other contaminants from electrical components of the pressure inducing elements. Pressure inducing elements are optionally augmented by a heating element which may be contained within the pad. Electrical power is conducted by a plug and cord assembly having pushbutton style controls disposed on a control panel located serially along the power cord. Control functions govern frequency of impacts and on-off control of the heating element and on-off control of all power conducted to the pad.

Accordingly, it is one object of the invention to provide a massage device which employs a plurality or array of pressure inducing elements operated in random order.

It is another object of the invention to provide an array of individual pressure inducing elements sufficient in number so that location of subsequent impacts cannot be anticipated.

It is a further object of the invention that pressure inducing elements be arranged on a flat pad.

Still another object of the invention is that the pad be flexible.

An additional object of the invention is to provide a heating element within the pad.

Yet another object of the invention is to control frequency of impacts and power to the heating element and to the pad generally.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
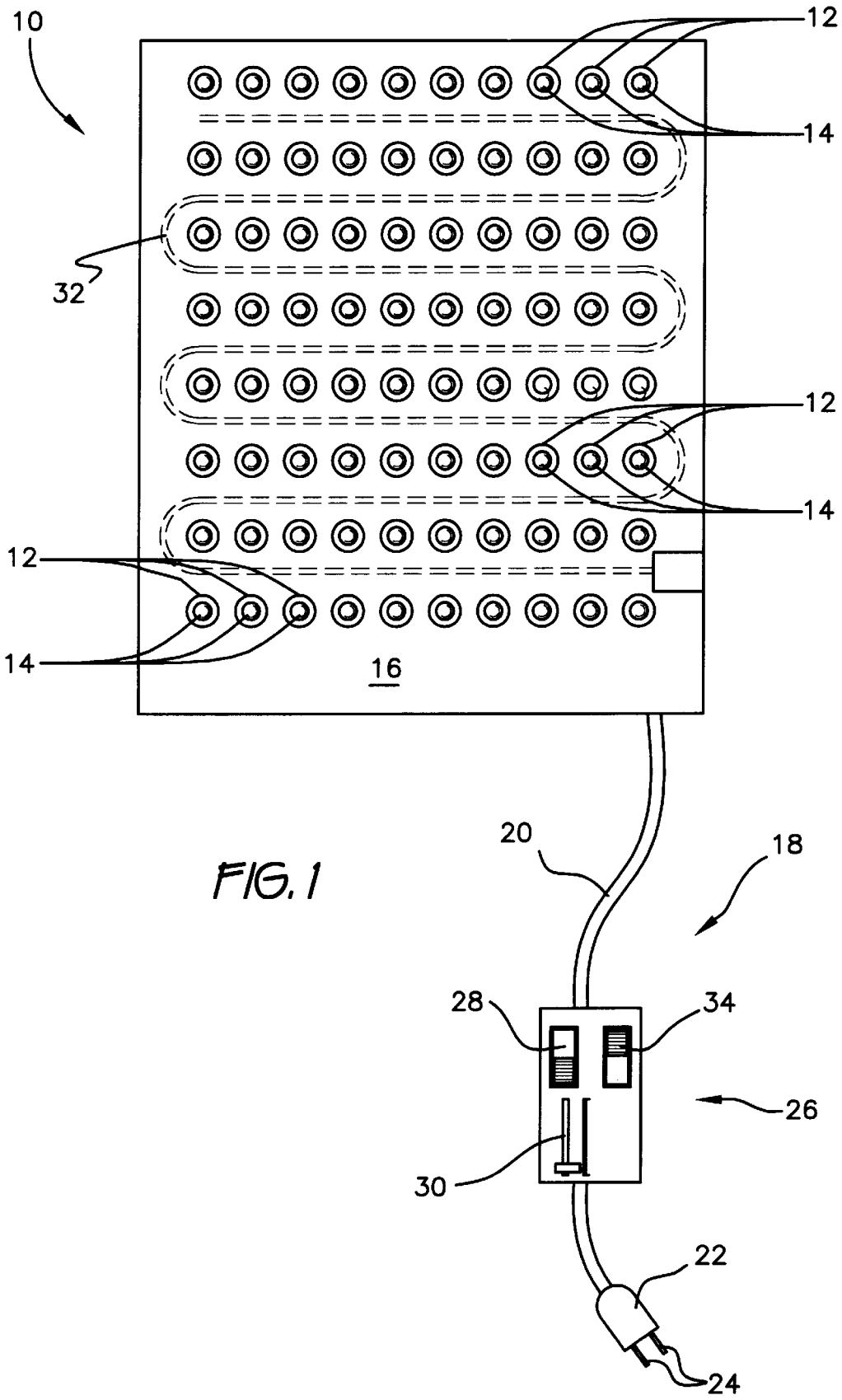
FIG. 1 is a top plan view of the novel apparatus.
Figure 2:
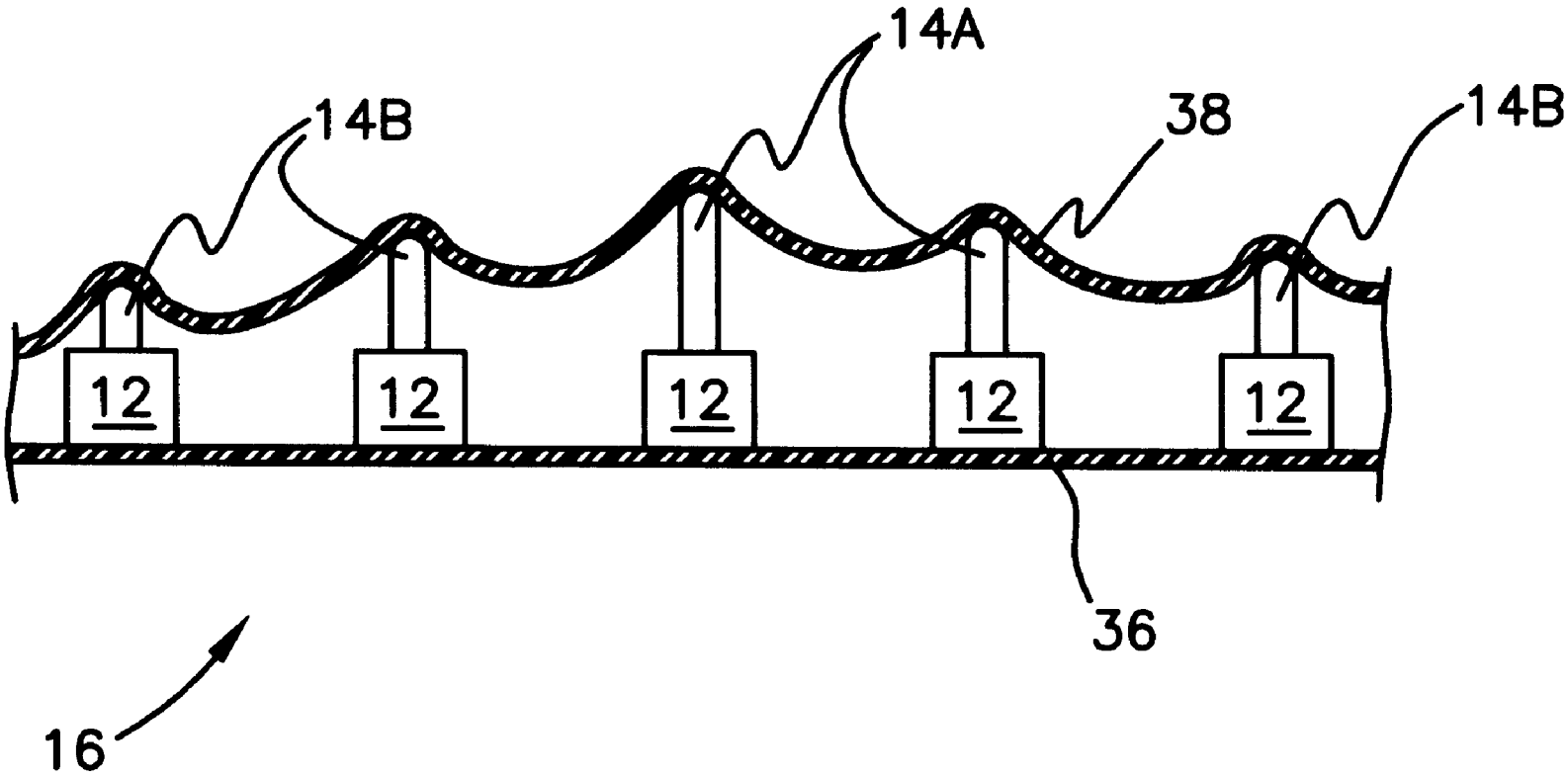
FIG. 2 is a diagrammatic side elevational, cross sectional detail view of a component shown at the upper part of FIG. 1, showing projectable elements, some of which are in an extended or projecting position and some of which are in a retracted position, some components of the invention being omitted for clarity of the view.

Turning now to FIG. 1 of the drawings, novel massaging device 10 is seen to comprise a plurality of pressure inducing elements 12 each having a plunger 14 disposed to move in reciprocating fashion between a first position wherein plunger 14 is extended and a second position wherein plunger 14 is retracted. An exemplary pressure inducing element 12 is shown in greater detail in FIG. 3. Pressure inducing elements 12 are held within a pad 16 in a flat array such that each plunger 14 projects from pad 16 in the first position and withdraws into pad 16 in the second position. Length and width of pad 16 are each at least ten times the magnitude of the thickness of pad 16, where thickness designates the vertical dimension as shown in FIG. 2. Illustratively, pad 16 may be ten times greater in length and also in width than in thickness. Upper and lower surfaces of pad 16, when laid flat, are also flat.

Pressure inducing elements 12 are solenoid operated devices. Electrical power is supplied from a plug and cord assembly 18 including a multiconductor cord 20 and a plug 22 having prongs 24 arranged to be insertably compatible with standard electrical receptacles (not shown) conventionally provided in buildings to enable ready connection to AC electrical power. A controller 26 is provided serially within cord 20 for controlling functions of massage device 10. A switch 28 controls power to pressure inducing elements 12. A second switch 30 is arranged to modify characteristics of standard electrical power, such as voltage and frequency. Switch 30 will be understood to incorporate all structure necessary to accomplish its intended function, such as resistors, variable voltage transformer, inverter, and other known elements as required. Switch 30 varies the frequency or speed of operation of plungers 14. Switch 28 is a master switch enabling electrical circuitry to plungers 14 to be opened and closed when desired.

Preferably, pad 16 has a heating element 32 contained within. Heating element 32 is arranged to be in heat exchange relation to the outer surfaces of pad 16, so as to be able to apply heat to a body also receiving therapy from impacts from plungers 14. A further switch 34 controls power to heating element 32.

FIG. 2 shows how pressure inducing elements 12 are arranged within pad 16. Pressure inducing elements 12 are fixed to a base membrane 36 covering the bottom of pressure inducing elements 12 and are covered at the top by a second membrane 38. Both membranes 36, 38 are flexible, as are all structural components of pad 16, so that pad 16 can conform to body contours. Plungers 14A of some pressure inducing elements 12 are shown in the extended position and plungers 14B of other pressure inducing elements 12 are shown in the retracted position. Membrane 38 flexes to accommodate projection of plungers 14 from pad 16 in the extended position. Membranes 36, 38 exclude contaminants from the interior of pad 16 and conduct heat from heating element 32.

A motive element operating each pressure inducing element 12 is described with reference to FIG. 3. Each pressure inducing element 12 has one plunger 14 slidably entrapped within a housing 40. Plunger 14 is constrained to move linearly in the direction of axis 42 within a chamber 44 formed in housing 40. Plunger 14 includes a magnetically responsive mass 46. Chamber 44 is surrounded by a conductive winding 48 which, when energized, generates a magnetic field attracting mass 46. Magnetic attraction draws plunger 14 into the extended position shown in FIG. 2. When power to winding 48 is discontinued, a spring 50 urges plunger 14 into the retracted position actually depicted in FIG. 3. Periodic energization of winding 48 causes plunger 14 to reciprocate between the first and second positions.

Figure 3:
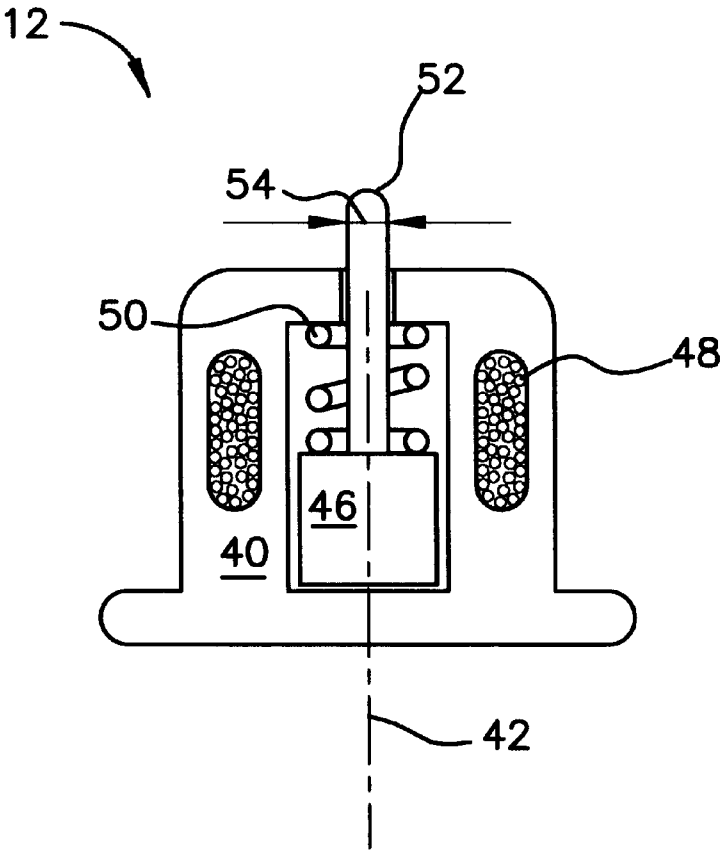
FIG. 3 is a cross sectional detail view of one projectable element shown in FIG. 1.

FIG. 3 also shows preferred configuration of plunger 14. The top 52 of plunger 14 is domed, or otherwise configured to be blunt, so that there are no sharp edges or points which could rupture membrane 38. The diameter 54 of plunger 14 preferably has a diameter within a range of one quarter inch to one half inch.

Figure 4:
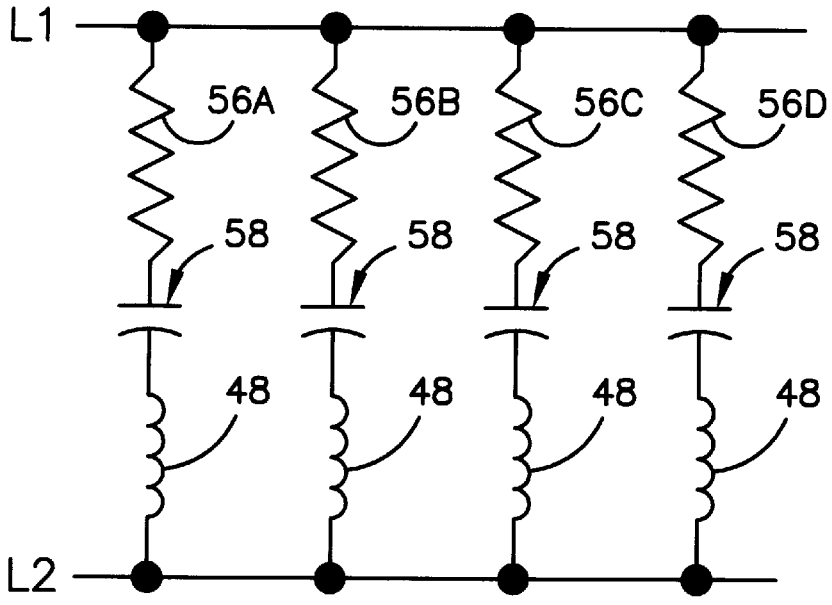
FIG. 4 is an electrical schematic illustrating control of the projectable elements of FIG. 2.

FIG. 4 shows electrical circuitry arranged to cause windings 48 to be energized randomly. AC power applied to conductors L1, L2 is applied to resistance-capacitance circuits each having a resistor 56A, 56B, 56C, or 56D and a capacitor 58. Conductors L1, L2 are part of the electrical circuitry connected to switches 28, 30. Resistors 56A, 56B, 56C, 56D are selected to provide different resistance characteristics. This will cause capacitors 58 to discharge at different time intervals. Resistance characteristics are varied randomly, so that the order in which capacitors 58 discharge does not cause a perceptible organized pattern.

As an alternative to or in addition to variation of resistance characteristics, capacitance of capacitors 58 may be varied. Arrangement of resistors and capacitors need not be truly or mathematically random, but rather must be sufficiently varied so that a person being massaged cannot anticipate the pattern of plunger actuations.

It is not necessary that the apparatus provided for carrying out the invention be limited to that described above. For example, plungers 14 may be operated by hydraulic and pneumatic arrangements (not shown). Even when electrically operated, plungers 14 may be indirectly connected to a motive element. For example, a motive element may contain a rotary motor connected by rack and pinion arrangement to move plungers 14 linearly (this embodiment is not shown). As a further alternative, a linearly moved member of a solenoid may be indirectly connected to its associated plunger by rack and pinion elements or in any other suitable way.

Figure 5:
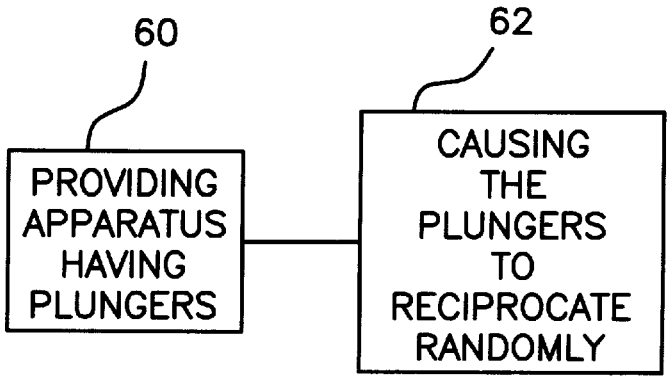
FIG. 5 is a block diagram showing steps of a method of practicing the invention.

The invention may further be regarded as a method of massaging a person. As summarized in FIG. 5, the method includes a step 60 of providing massage apparatus having a plurality or array of reciprocatable plungers, and a step 62 of causing the plungers to reciprocate throughout the array randomly between extended positions projecting from the massage apparatus and retracted positions wherein the plungers are received within the massage apparatus.

It is to be understood that the present invention is not limited to the embodiments described above, but encompasses any and all embodiments within the scope of the following claims.

I claims:

1. A massaging device for applying pressure to a plurality of locations on a long fiber muscle in a random timing and pattern, said massaging device comprising:

at least six pressure inducing elements, each of said pressure inducing elements being associated with one location of the plurality of locations and including a plunger disposed to move in reciprocating fashion between a first extended position and a second retracted position, said plunger being generally cylindrical, having a domed tip, and having a diameter between one quarter and one half an inch;

a flexible pad adapted to substantially conform to the long fiber muscle, said flexible pad holding and supporting said at least six pressure inducing elements in an array such that all of said plungers extend in the same general direction relative to said flexible pad;

a plurality of motive elements, each motive element of said plurality of motive elements being disposed to move one of said plungers between said first and said second positions; and separate timing means for each said motive element, each said separate timing means individually operating said motive element's associated plunger such that a random operation of the entire plurality of pressure inducing elements results delay occurs between successive extensions thereof, thereby in a random timing and pattern whereby;

when placed on a long fiber muscle or group of muscles, the size of the pressure inducing elements, the arrangement of the pressure inducing elements, and the random time delay in each of the pressure inducing elements all act on the Golgi tendon organ to suddenly relax the entire long fiber muscle.

2. The massaging device according to claim 1, further comprising:

a first membrane covering a top of all of said pressure inducing elements; and a second membrane covering a bottom of all of said pressure inducing elements.

3. The massaging device according to claim 1, further comprising a heating element disposed within said pad.

4. The massaging device according to claim 1, wherein:

each said pressure inducing element includes an electrical solenoid; and each said separate timing means includes a random electric signal that energizes said solenoid to extend said plunger.

5. A massaging device for applying pressure to a plurality of locations on a long fiber muscle in a random timing and pattern, said massaging device comprising:

an array of at least six pressure inducing elements, each of said pressure inducing elements being associated with one location of the plurality of locations and including a plunger disposed to move in reciprocating fashion between a first extended position and a second retracted position, each said plunger being generally cylindrical, having a domed tip, and having a diameter between one quarter and one half inch, each said pressure inducing element further includes an electrical solenoid and said electrical solenoid includes windings;

a flexible pad adapted to substantially cover the long fiber muscle, said flexible pad holding and supporting said at least six pressure inducing elements in said array such that all of said plungers extend in the same general direction relative to said flexible pad;

a plurality of motive elements, each motive element of said plurality of motive elements being disposed to move one of said plungers between said first and said second positions; and separate timing means for each said motive element, each said separate timing means includes a random electric signal that energizes said solenoid and where each said separate timing means further includes a series circuit comprising a resistor, a capacitor, and said electrical solenoid windings, each said separate timing means individually operating said motive element's associated plunger such that a random operation of the entire array of pressure inducing elements results in a random timing and pattern whereby;

when placed on a long fiber muscle or group of muscles, the size of the pressure inducing elements, the array of pressure inducing elements, and the random delay of the pressure application all act on the Golgi tendon organ to suddenly relax the entire long fiber muscle.

* * * * *